United States Patent [19]

Armstrong

[11] Patent Number: 4,666,333

[45] Date of Patent: May 19, 1987

[54] MANHOLE CASTING POSITIONING APPARATUS

[76] Inventor: Ronald B. Armstrong, 1287 E. 27th Street, North Vancouver, B.C., Canada, V7J 1S5

[21] Appl. No.: 768,138

[22] Filed: Aug. 22, 1985

[51] Int. Cl.[4] ..... E02O 29/14

[52] U.S. Cl. ..... 404/26; 404/25

[58] Field of Search ..... 404/25, 26; 52/19, 20, 52/21

[56] References Cited

U.S. PATENT DOCUMENTS

| | | | |
|---|---|---|---|
| 2,166,632 | 7/1939 | Hardesty et al. | 52/20 |
| 4,050,839 | 9/1977 | Vollmar | 52/21 X |

FOREIGN PATENT DOCUMENTS

| | | | |
|---|---|---|---|
| 3220480 | 12/1983 | Fed. Rep. of Germany | 52/20 |
| 7506577 | 10/1976 | France | 404/25 |
| 0011226 | 1/1983 | Japan | 52/20 |

*Primary Examiner*—Stephen J. Novosad
*Assistant Examiner*—Thomas J. Odar
*Attorney, Agent, or Firm*—Barrigar & Oyen

[57] ABSTRACT

The present invention provides a casting positioning apparatus, which is used to position a casting in relation to an upper end of manhole. The apparatus includes a sleeve unit which has open upper and lower ends, and which is moveable in lateral dimensions between a first position and a second position. In the first position, the lower end of the sleeve unit can freely engage with the upper end of the manhole. In the second position, the upper end of the sleeve unit can support the casting in a position mounted on it, while at the same time an engaging section of the lower end of the sleeve unit can frictionally engage against a side of the upper end of the manhole. Such frictional engagement is with sufficient force such that the sleeve and the mounted casting can be supported by such engagement, while allowing the upper end of the sleeve to be moved with respect to the upper end of the manhole. By such means, the casting can be positioned with respect to the upper end of the manhole. A sleeve unit adjusting means is additionally provided for retaining the sleeve unit in the second position.

25 Claims, 7 Drawing Figures

MANHOLE CASTING POSITIONING APPARATUS

FIELD OF THE INVENTION

This invention relates to an apparatus, and a method utilizing such apparatus, for positioning a manhole casting in relation to an upper end of a manhole.

DESCRIPTION OF PRIOR ART

Manholes for sewers, storm drains, and other facilities, are typically assembled by stacking a plurality of precast cylindrical concrete barrel sections, typically of a standard height, to the approximate desired height. A cylindrical, open ended, concrete lid is then positioned on top of the uppermost of such stacked barrel sections, which concrete lid forms what may be regarded as an upper end of the manhole. The lower end of the manhole (i.e. the manhole base) is initially set such that upon such construction, the concrete lid (again referred to as the upper end of the manhole), will sit from 9 inches to 15 inches below a finished road grade. A steel or iron casting, which normally supports a lid for the manhole, is then positioned in relation to the upper end of the manhole. Such casting typically has a height of about 7 inches so that a 1 inch to 8 inch space is available between the casting and the upper end of the manhole. This space is typically filled in by positioning layers of bricks therein, in a process known as bricking, so that an upper end of the casting will sit flush with the road grade. The 1 to 8 inch space serves three purposes. First, if minor elevation error is made in the end positioning of the upper end of the manhole, and the road grade, such space serves as a lee way zone for correcting such error. Second, the space allows the casting to be set at various heights or slopes, such that the upper end of it is flush with the road grade. This is conventionally accomplished by using chips of bricks as the final layer during the bricking operation, as required. Third, municipalities generally require that such 1 to 8 inch space, or bricking zone exists, so that should the finished road ever be redone and lowered, it is only necessary to remove the desired number or bricks in order to re-establish the upper end of the casting flush with the new road grade, rather than digging up the upper end of the manhole itself and replacing the uppermost barrel section.

Following the placing of the necessary bricks, mortar was poured over the outside of the bricks and over the upper end of the manhole and the lip of the casting, in order to hold the bricks and the casting in position. Finally, the inside brick facing would be skimmed of any mortar so that an individual descending in a completed manhole assembly, would not scrape or otherwise injure himself during such descent.

The above conventional bricking procedure, is relatively expensive, and time consuming even for one skilled in such procedure. Other attempts have been made though, to position the casting in relation to the upper end of the manhole.

U.S. Pat. No. 3,629,981 to McCaffery discloses an arrangement for altering the height of a manhole lid (as distinguished from a casting), which arrangement consists of an inner casing threadedly engaged in an outer casing. U.S. Pat. No. 3,858,998 to Larrson et al discloses an arrangement to alter the angle of a manhole cover. The device of this latter patent utilizes a number of bolts around the cover, which can be independently adjusted so as to alter the angle of the cover.

U.S. Pat. No. 3,968,600 to Bowman discloses an arrangement which raises the height of a manhole cover, while maintaining it horizontal. This is accomplished by an adjusting ring inserted between the cover and the surface above which the height of the manhole cover is to be raised.

U.S. Pat. No. 4,038,789 to Axgard et al also has an arrangement for adjusting the height and angle of a manhole cover. This arrangement includes an inner frame which can telescope and tilt within an outer frame. Such telescoping and tilting action is accomplished by bolts which apparently bear against an upwardly angled inner surface of the outer frame. U.S. Pat. No. 1,639,495 to Frame allows a manhole casting to be tilted by using a number of rings which are rotatable with respect to one another. U.S. Pat. No. 2,930,295 to Hale provides a manhole casting height adjustment mechanism, by means of an upper frame which can be raised relative to a lower frame by virtue of threaded studs. U.S. Pat. No. 4,225,266 to Fier discloses an expandable ring which is positioned on top of an already installed casting, so as to raise the height of a manhole lid only. U S. Pat. No. 4,281,994 to Bowman utilizes a toothed post and mating receptacle assembly, in order to allow raising of a manhole cover only. The assembly has a number of sections adjustable with respect to one another so that the assembly can be accomodated within different diameter manholes.

Other devices include that disclosed in U.S. Pat. No. 4,337,005 to LeBaron. In the LeBaron arrangement, a number of rings can be stored adjacent, and outside of, a manhole casting, which rings can be inserted therebeneath for raising the height of the manhole casting as required. In addition, U.S. Pat. No. 4,466,219 to Campolito discloses an arrangement which can raise the height of a manhole cover. The Campolito arrangement apparently includes two split rings which engage around an annular inner flange of a manhole casting, and on top of the uppermost of which, can rest the actual cover.

None of the above devices, disclose a relatively simple means for positioning a manhole casting, which device can be readily reused in a method to readily accomplish such positioning for many castings, and which is further of relatively simple construction. In addition, apparently due to the complexity of the above devices, as well as the fact that they do not readily permit positioning a manhole casting in relation to the upper end of the manhole, the bricking method of accomplishing such positioning, is apparently still in wide use.

SUMMARY OF THE INVENTION

The present invention provides a casting positioning apparatus, which is used to position a casting in relation to an upper end of manhole. The apparatus includes a sleeve unit which has open upper and lower ends, and which is moveable in lateral dimensions between a first position and a second position. In the first position, the lower end of the sleeve unit can freely engage with the upper end of the manhole. In the second position, the upper end of the sleeve unit can support the casting in a position mounted on it, while at the same time an engaging section of the lower end of the sleeve unit can frictionally engage against a side of the upper end of the manhole. Such frictional engagement is with sufficient force such that the sleeve and the mounted casting can be supported by such engagement, while allowing the upper end of the sleeve to be moved with respect to the upper end of the manhole. By such means, the casting can be positioned with respect to the upper end of the manhole. A sleeve unit adjusting means is additionally provided for retaining the sleeve unit in the second position.

Preferably, the foregoing sleeve unit is an inner sleeve unit the lower end of which can freely enter the upper end of the manhole, when the sleeve unit is in the retracted position. In such case, when in the expanded position, engaging section of the lower end of the inner sleeve unit can frictionally engage against the inside of the upper end of the manhole, so as to support the inner sleeve and the casting mounted thereupon. In such situation though, the upper end of the inner sleeve can simultaneously be moved as previously described.

The positioning apparatus additionally usefully has an outer sleeve unit having open upper and lower ends. Such outer sleeve unit has lateral dimensions such that it can freely engage over a casting mounted on the inner sleeve, while still leaving a gap between the casting and the outer sleeve. In addition, the frictional engagement which can be obtained between the inner sleeve unit and the inside of the upper end of the manhole, is sufficient such that fluid cement can be retained between the inner and outer sleeve units.

Preferably, the inner and outer sleeves are generally cylindrical in shape, in order that they can be readily used with the typical generally cylindrical upper end of a manhole. Furthermore, the outer sleeve unit is preferably moveable in lateral dimensions between a first and second position, the second position allowing the outer sleeve unit to engage over a casting as described. In such case, an outer sleeve unit adjusting means is provided for retaining the outer sleeve unit in the expanded position.

The engaging section of the inner sleeve preferably comprises a laterally expandable gasket disposed about the lower end of the sleeve. The gasket has an outer surface which can firmly frictionally engage against the inside surface of an upper end of the manhole when the inner sleeve is in the expanded position. An inner surface of the gasket though, is such as to allow an inner sleeve of the inner sleeve unit, to move frictionally thereagainst so that the upper end of the inner sleeve unit can be moved as already mentioned. This is usefully accomplished by the outer surface of the gasket having a plurality of vertically spaced ridges around it, while the inner surface of the gasket is substantially smooth.

The inner sleeve unit is preferably constructed such that when in the expanded position with the engaging section engaged against the inside of the upper end of the manhole, the upper end of the inner sleeve unit can be moved vertically and tilted with respect to the upper end of the manhole. Further preferably, a peripheral edge of an end of the inner sleeve, is disposed at an angle to an upwardly extending axis of the inner sleeve. The inner sleeve is further preferably arranged to be invertible in use with the upper end of the manhole. That is, the inner sleeve is such that the "upper" end of it can function as the lower end by inverting the inner sleeve.

The outer sleeve unit may usefully be constructed in the form of a belt. In such case, the outer sleeve adjusting means has a receptacle formed in a first end of the belt, through which receptacle a second end of the belt can pass. The outer sleeve adjusting means further comprises locking means disposed on the receptacle, for locking the second end of the belt in a position passing through the receptacle, corresponding to the retracted position of the outer sleeve unit.

A method of positioning a casting, utilizing the above apparatus, is further provided. The method basically involves placing the lower ends of the inner sleeve unit in frictional engagement with the inside of the upper end of the manhole, and retaining it therein by its respective adjusting means. The outer sleeve unit is freely engaged over the mounted casting and the inner sleeve unit, while the outer sleeve unit is in the second position. This is such that the outer sleeve unit rests on the upper end of the manhole with an upper end of the outer sleeve unit extending above a lowermost end of the mounted casting. Either before or after the lower end of the outer sleeve is so positioned, the casting can be mounted upon the upper end of the inner sleeve unit. Following such mounting, the casting can be positioned with respect to the upper end of the manhole, by repeatedly striking the mounted casting. Following all of this, cement can be poured between the inner and outer sleeve units, to a height above a lowermost end of the mounted casting such that the cement, when cured, will retain the casting in position relative to the upper end of the manhole.

DRAWINGS

Embodiments of the invention will now be described with reference to the drawings, in which.

DETAILED DESCRIPTION OF EMBODIMENTS OF THE INVENTION

It should first be noted that words such as "upper", "lower", "laterally", and similar words importing orientation are used in a relative rather than absolute sense. Such words are used with particular reference to the positioning apparatus as positioned during normal use of it.

Figure 1:
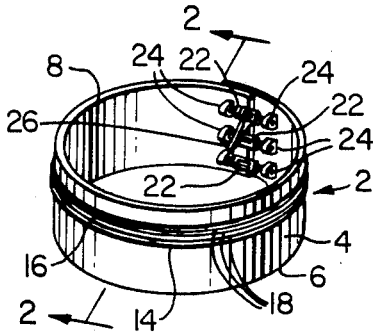
FIG. 1 is a perspective view of an inner sleeve unit of an apparatus of the present invention.
Figure 2:
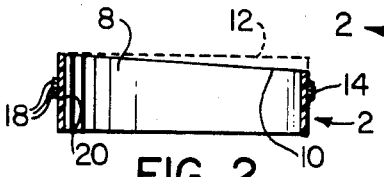
FIG. 2 is a vertical cross section along the line 2—2 of FIG. 1.
Figure 3:
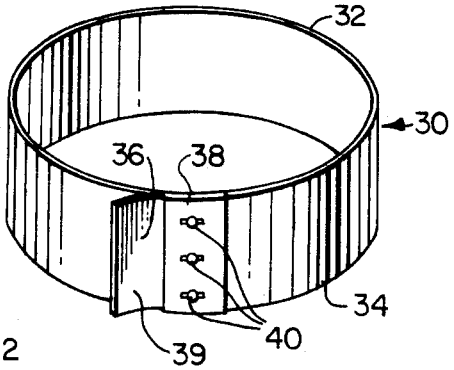
FIG. 3 is a perspective view of an outer sleeve unit of an apparatus of the present invention.
Figure 4:
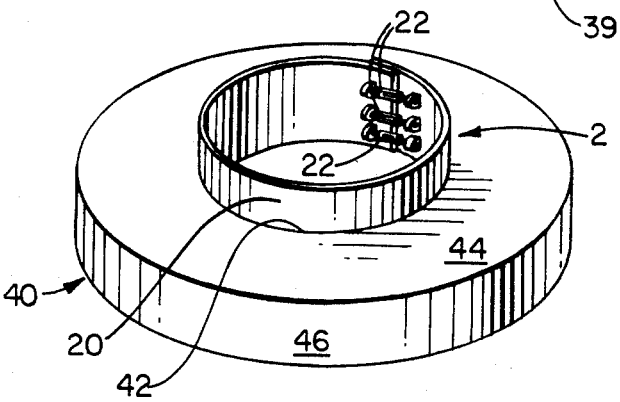
FIGS. 4–7 are perspective views, which illustrate in sequence the manner of using the apparatus of FIGS. 1–3 to position a casting relative to an upper end of a manhole.
Figure 6:
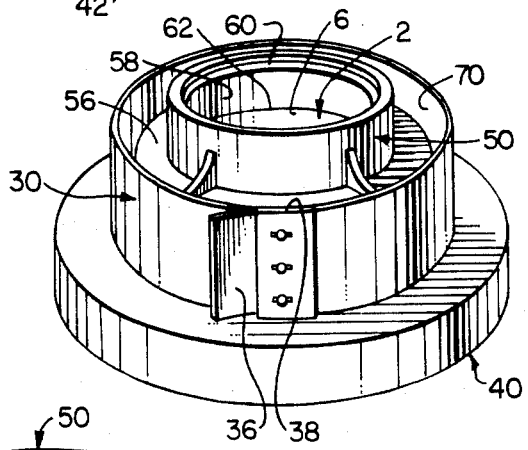
Figure 7:
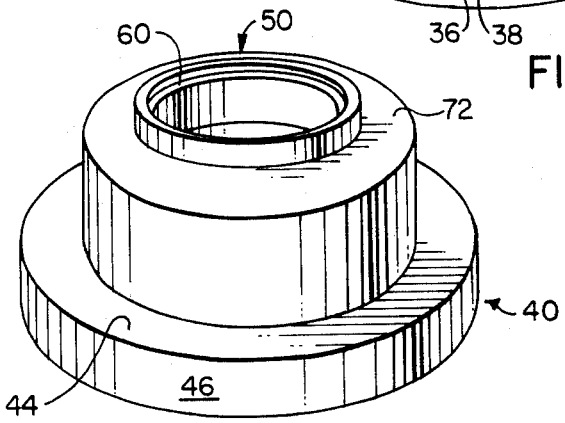

Referring in particular to FIGS. 1–3, the positioning apparatus shown has an inner sleeve unit 2, which consists of an inner sleeve 4, and which has open upper and lower ends 6, 8, respectively. In this regard, it will be noted that inner sleeve unit 2 is shown in a 180° inverted position in FIG. 1, from its position during normal use, as will be described later. A peripheral edge 12 of upper end 8 is disposed at an angle to an upwardly extending axis of inner sleeve unit 2, that is an axis which extends upwardly through open upper and lower ends 6, 8, respectively. Inner sleeve 4 of inner sleeve unit 2 is constructed of a material such that it is laterally expandable from a contracted position as shown in FIG. 1, to an expanded position as best shown in FIGS. 4 and 6.

Inner sleeve unit 2 includes a generally cylindrical gasket 14 disposed around the lower end 8 of inner sleeve unit 2. Gasket 14 is of a material such that it is laterally expandable with the remainder of inner sleeve unit 2, when inner sleeve unit 2 moves to the expanded position. Gasket 14, has on its outer surface, a plurality of vertically spaced ridges 18 extending thereabout. An inner surface 20 of gasket 14, is substantially smooth and fairly snugly grips against inner sleeve 4.

An inner sleeve unit adjusting means is provided, for reversably moving inner sleeve unit 2, between the retracted and expanded positions, and for retaining it in either of such positions. The inner sleeve adjusting means consists of three turnbuckles 22, the ends 24 of which are attached by means of studs extending from inner sleeve unit 4, and corresponding nuts. Turnbuckles 22 can be adjusted by means of a ratchet 26, shown in FIG. 1 in a position removeably engaged upon one of the turnbuckles.

The casting positioning apparatus also includes a substantially cylindrical outer sleeve 30, which has an open upper end 32, and an open lower 34. Outer sleeve 30 is preferably constructed in the form of a belt, with a first end 36 of such belt, having a receptacle 38 through which a second end 39 of such belt, can pass. Receptacle 38 has three threaded bores into which are fitted three mating bolts 40 (preferably having a wing nut type head). Bolts 40 and the mating threaded bores in receptacle 38, act as locking means disposed on receptacle 38, to retain the second end 36 at a desired position within receptacle 38. Outer sleeve unit 30 is also made of a material such that it can be moved between an expanded position such as shown in FIG. 3, to a retracted position such as shown in FIG. 6. When bolts 40 are loosened of course, this permits such contraction, for example by pulling on second end 36. Bolts 40 can then be tightened against second end 36, to retain outer sleeve 30 in the contracted position.

In construction of the above apparatus, outer sleeve unit 30, is typically made of a heavy, somewhat resilient, plastic to allow for movement of the foregoing sleeve units between their expanded and contracted positions. In addition, inner sleeve 4 and outer sleeve unit 30, can both can be conveniently made from flat strips of such plastic. In particular, for use on a typical manhole having an inside diameter of 25 inches, such a flat strip could conveniently have the following dimensions for inner sleeve 4:

Total length = 78 inches
Width at mid-point along length = 12 inches
Width at both ends = 10.5 inches Outer sleeve unit 30, in such situation, may usefully have the following diemensions:

Width (constant along length of strip) = 10 inches
Length = 271 inches

A method of positioning a casting in relation to the upper end of a manhole, utilizing the above apparatus, will now be described. In this regard, FIGS. 4 through 7 show an upper end 40 of a manhole, which upper end 40 has an outer side 46, an inner side 42 (sometimes referred to in this application, simply as the outside and inside respectively, of the upper end), and an upper surface 44. Again, in a typical manhole, inner side 42 will have a diameter of about 25 inches. A casting 50 to be positioned in relation to upper end 40, is shown most clearly in FIGS. 5 and 6. Casting 50 has an upper end 52, and a lower end 54 which includes a radially outwardly extending flange 56. Casting 50 further has an inside lip 58, with an upper edge 60 upon which a conventional manhole lid can rest, and a lower edge 62. Typically, inside lip 58 has an inside diameter of 24 inches, that is one inch less than the inside diameter of a typical upper end 40 of a manhole (i.e. the inside diameter of the upper end 40 being taken as the diameter of the inner side 42 thereof).

Figure 5:
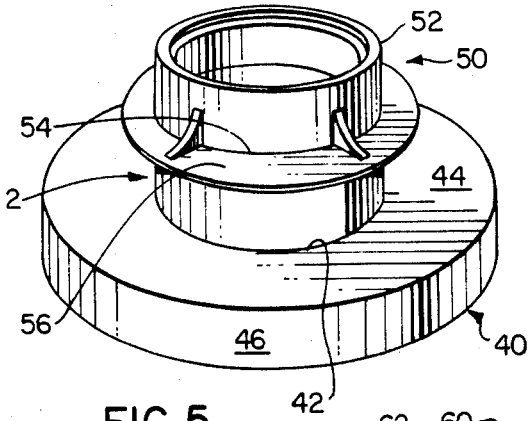

To position casting 50 in relation to upper end 40, lower end 8 of inner sleeve unit 2, is freely inserted into upper end 40 of the manhole, while inner sleeve unit 2 is in the retracted position shown in FIG. 1. By "freely inserted" is meant without any substantial resistance as a result of frictional engagement between lower end 8 of inner sleeve unit 2 and inner side 42 of upper end 40 of the manhole. Ratchet 26 is then used to turn turnbuckles 22 such that inner sleeve unit 2 is moved from the contracted position in FIG. 1, to the expanded position in FIG. 4. Again, gasket 14 is made of sufficiently flexible material so as to comfortably expand in diameter from the retracted position of inner sleeve unit 2, to the expanded position thereof. When the inner sleeve unit 2 is in the expanded position as shown in FIG. 4 then, an engaging section of inner sleeve 2, that is in the embodiment of inner sleeve 2 illustrated, gasket 14, is frictionally engaged against inner side 42 of upper end 40. Because of the nature of turnbuckles 22, these will of course retain inner sleeve section 2 in the expanded position. The degree of the foregoing frictional engagement will depend upon the diameter of inner sleeve section 2 when in the expanded position. In the case of the dimensions of inner sleeve section 2 and upper end 40 of the manhole already given, inner sleeve section 2 will be able to engage against the inner side 42 of upper end 40, with sufficient force such that both inner sleeve unit 2 and a casting mounted thereupon as will shortly be described and as shown in FIG. 5, can both be supported by such engagement. In addition, such frictional engagement must be sufficient to allow inner sleeve section 2 to act as a part of a concrete form, as again will shortly be described.

It should also be noted that when inner sleeve unit 2 is in the expanded position, it is still able to be moved with respect to upper end 40 of the manhole to position casting 50 mounted thereupon, in relation to upper end 40. Such movement is allowed by virtue of inner sleeve 4 being able to slide to some degree along the substantially smooth inside surface 20 of gasket 14, while outside surface 16 is firmly frictionally engaged against inner surface 42 of upper end 40 of the manhole, so as to be normally immovable with respect thereto when inner section 2 is in the expanded position. Inner sleeve 4 though, and gasket 14, are constructed though such that the movement which inner sleeve 4 can accomplish past inner surface 20, when inner sleeve unit 2 is in the expanded position, is such as to allow vertical and tilting movement of inner sleeve 4 with respect thereto, although such movement meets with considerable frictional resistance. In particular, such movement can only normally be accomplished while inner sleeve unit 2 is in the expanded position, by the application of blows to inner sleeve section 2 (preferably indirectly by applying such blows to casting 50 mounted thereupon) such as by striking with a hammer.

Casting 50 is then mounted on upper end 6 of inner sleeve unit 2, as shown in FIG. 5. By virtue of the fact that lip 58 will have an inside diameter which is slightly less than the diameter of inner sleeve unit 2 when in the expanded position (the latter diameter corresponding approximately to the diameter of inner side 42 of upper end 40), casting 50 is able to rest on inner sleeve unit 2 when in the expanded position, by virtue of lower end 62 of lip 58 resting upon upper end 6 of inner sleeve unit 2. In the example of the typical dimensions already given, upper end 6 of inner sleeve unit 2, when in the expanded position shown in FIG. 4, would have an inside diameter of approximately 25 inches, whereas lip 58 would have inside diameter of approximately R5 24 inches. Thus, lower end 62 of lip 58 would rest upon upper end 6 of inner sleeve unit 2.

Casting 50 then, in particular upper end 52 thereof, can then be positioned with respect to upper end 40 of the manhole, by striking casting 50 with a hammer or the like, to move casting 50 and the upper end 6 of inner sleeve unit 2, to the required elevation and angle. In particular, it has been found that with the dimensions mentioned above, upper end 52 of casting 50 could be inclined at an angle such that a lower portion of upper end 52 of casting 50, could be as much as 1.5 inches below an upper portion thereof, without any substantial distortion of inner sleeve 4. If more than the foregoing 1.5 inch inclination is required, gasket 14 can be moved to upper end 6 of inner sleeve unit 2, and inner sleeve unit 2 then inverted such that upper end 6 thereof would then engage within upper end 40 of the manhole.

Following the above last step, or prior to it, outer sleeve unit 30 is positioned in at least a partially expanded position, of sufficient lateral dimensions (in the present case, diameter) such that it can be freely engaged over casting 50 when in the mounted position shown in FIG. 5. Again, by "freely engaged" in the foregoing terms, is meant without any substantial frictional engagement therebetween. Such arrangement further leaves at least some gap between casting 50 and outer sleeve 30, such as space 70 shown in FIG. 6. Outer sleeve 30 will then be allowed to rest upon upper end 40. After casting 50 has already been positioned as described above, fluid cement can then be poured into gap 70 between inner sleeve unit 2 and outer sleeve unit 30, such that inner sleeve unit 2 and casting 50 mounted thereupon, outer sleeve unit 30, and upper surface 44 of upper end 40 of the manhole, will all serve as a cement form. The cement is poured to a height above a lowermost end of the mounted casting 50 (the lowermost end being flange 56) such that when the cement is cured, casting 50 will be retained in position above upper end 40 of the manhole. In addition, when such cement has cured, bolts 40 can then be slackened to expand outer sleeve unit 30, and turn buckles 22 of inner sleeve unit 2 also adjusted to contract inner sleeve unit 2 to the retracted position. In such positions, one will be able to remove both inner sleeve unit 2 and outer sleeve 30, leaving only the cured concrete retaining casting 50 in the required position. Such cured concrete will have a smooth finish on its radially inner and outer surfaces, as a result of the smoothness of inner sleeve 4 and outer sleeve unit 30. Furthermore, there will not be any noticeable amounts of rough cement drippings on the inner surface 42 of upper end 40, since gasket 14 of inner sleeve unit 2, will substantially prevent fluid cement from passing thereby during the above operation.

It will be noted that a number of changes can be made to the above embodiments of the apparatus and method. For example, in some applications gasket 14 might be dispensed with, although there may be a greater tendency of fluid cement to leak past such an inner sleeve unit when used in the method described above. In addition, one might for some purposes dispose both an upper and a lower peripheral edge of the inner sleeve unit, at an angle to the upwardly extending axis thereof. Further, in the method itself, if the diameter of lip 58 of casting 50 is not somewhat less then the diameter of inner surface 42 of upper end 40 of the manhole, a casting could still be mounted upon upper end 6 of inner sleeve unit 2, by turning the uppermost turn buckle 22 to expand the upper end 6 of inner sleeve unit 2, a greater distance than the lower end 8 thereof, such that inner sleeve section 2 would taper inwardly and downwardly when in the expanded position.

As will be apparent to those skilled in the art in light of the foregoing disclosure, many further alterations and modifications are possible in the practice of this invention without departing from the spirit or scope thereof. Accordingly, the scope of the invention is to be construed in accordance with the substance defined by the following claims.

I claim:

1. A casting positioning apparatus, for positioning a castng in relation to an upper end of a manhole, the apparatus comprising:

(a) a cylindrical inner sleeve unit having open upper and lower ends, the diameter of said inner sleeve unit being variable between a retracted position in which the lower end of said inner sleeve unit can freely enter the upper end of the manhole, and an expanded position in which the upper end of said inner sleeve unit can support the casting in a position mounted thereon, and in which an engaging section of the lower end of said inner sleeve unit can frictionally engage against the inside of the upper end of the manhole, with sufficient force so that the inner sleeve unit and the mounted casting can be supported by such engagement, while simultaneously allowing the upper end of the inner sleeve unit to be moved with respect to the upper end of the manhole to position the mounted casting with respect thereto; and (b) an inner sleeve unit adjusting means for retaining the inner sleeve unit in the expanded position.

2. A casting positioning apparatus as described in claim 1, additionally comprising an outer sleeve unit having open upper and lower ends, the outer sleeve unti having lateral dimensions such that said outer sleeve unit can freely engage over a casting mounted on said inner sleeve unit and leave a gap therebetween, and wherein said inner sleeve unit can be supported by frictional engagement of the engaging section thereof, against the inner side of the upper end of the manhole, when in the expanded position, so that fluid cement can be retained between said inner and outer sleeve units.

3. A casting positioning apparatus as described in claim 1, additionally comprising:

(i) an outer sleeve unit having open upper and lower ends, said outer sleeve unit being moveable in lateral dimensions between a first position and a second position in which said outer sleeve can freely engage over a casting mounted on said inner sleeve, and leave a gap therebetween; and (ii) an outer sleeve unit adjusting means for retaining the outer sleeve unit in the expanded position; and wherein said inner sleeves unit can be supported by frictional engagement of the engaging section thereof, against the inner side of the upper end of the manhole, when in the expanded position, so that fluid cement can be retained between said inner and outer sleeve units.

4. A casting positioning apparatus as described in claim 3, wherein said outer sleeve is generally cylindrical in shape.

5. A casting positioning apparatus as described in claim 1 wherein the engaging section of said inner sleeve comprises a laterally expandable gasket disposed about the lower end of the sleeve, the gasket having an outer surface which can firmly frictionally engage against the inside of an upper end of the manhole when said inner sleeve is in the expanded position, while an inner surface of the gasket allows an inner sleeve of the inner sleeve unit, to move frictionally against the inner surface, so that the upper end of the inner sleeve unit can be moved with respect to the upper end of the manhole to position the casting with respect thereto.

6. A casting positioning apparatus as described in claim 4 wherein the engaging section of said inner sleeve comprises a laterally expandable gasket disposed about the lower end of the sleeve, the gasket having an outer surface which can firmly frictionally engage against the inside of an upper end of the manhole when said inner sleeve is in the expanded position, while an inner surface of the gasket allows an inner sleeve of the inner sleeve unit, to move frictionally against the inner surface, so that the upper end of the inner sleeve unit can be moved with respect to the upper end of the manhole to position the casting with respect thereto.

7. A casting positioning apparatus as described in claim 1 wherein the upper end of said inner sleeve unit can be moved vertically and tilted, when the said inner sleeve unit is in the expanded position with the engaging section frictionally engaged against the inside of the upper end of the manhole.

8. A casting positioning apparatus as described in claim 6 wherein the upper end of said inner sleeve unit can be moved vertically and tilted, when the said inner sleeve unit is in the expanded position with the engaging section frictionally engaged against the inside of the upper end of the manhole.

9. A casting positioning apparatus as described in claim 5, wherein the outer surface of the gasket has a plurality of vertically spaced ridges therearound, and the inner surface of the gasket is substantially smooth.

10. A casting positioning apparatus as described in claim 8, wherein the outer surface of the gasket has a plurality of vertically spaced ridges therearound, and the inner surface of the gasket is substantially smooth.

11. A casting positioning apparatus as described in claim 1, wherein a peripheral edge of an end of the inner sleeve, is disposed at an angle to an upwardly extending axis of the inner sleeve unit.

12. A casting positioning apparatus as described in claim 3, wherein a peripheral edge of an end of the inner sleeve, is disposed at an angle to an upwardly extending axis of the inner sleeve.

13. A casting positioning apparatus as described in claim 8, wherein a peripheral edge of an end of the inner sleeve, is disposed at an angle to an upwardly extending axis of the inner sleeve.

14. A casting positioning apparatus as described in claim 11 wherein the inner sleeve of said inner sleeve unit is invertible in use with the upper end of the manhole.

15. A casting positioning apparatus as described in claim 3, wherein said outer sleeve unit comprises a belt, and wherein said outer sleeve adjusting means comprises:

(i) a receptacle formed in a first end of the belt, through which receptacle a second end of the belt can pass; and (ii) locking means disposed on the receptacle, for locking the second end of the belt in a position passing through the receptacle corresponding to the second position of the outer sleeve unit.

16. A method of positioning a casting in relation to an upper end of a manhole, using a casting positioning apparatus as described in claim 2, the method comprising:

(a) freely engaging the lower end of the sleeve unit with the upper end of the manhole, while the sleeve unit is in the first position;

(b) moving the sleeve unit from the first position to the second position so that the lower end of the sleeve unit is frictionally engaged against a side of the upper end of the manhole, so that the sleeve unit and a mounted casting can be supported by such engagement; and (c) retaining the sleeve unit in the second position by the sleeve unit adjusting means;

(d) mounting the casting on the upper end of the sleeve unit; and (e) moving the upper end of the sleeve unit with respect to the upper end of the manhole, to position the casting with respect thereto.

17. A method of positioning a casting in relation to an upper end of manhole, using a casting positioning apparatus as described in claim 2, the method comprising:

(a) freely inserting the lower end of the inner sleeve unit into the upper end of the manhole, while the inner sleeve unit is in the retracted position;

(b) moving the inner sleeve unit from the contracted to the expanded position so that the engaging section of the inner sleeve unit is frictionally engaged against the inside of the upper end of the manhole, so that the inner sleeve unit and a mounted casting can be supported by such engagement;

(c) retaining the inner sleeve unit in the expanded position by the inner sleeve unit adjusting means;

(d) mounting the casting on the upper end of the inner sleeve unit;

(e) moving the upper end of the inner sleeve unit with respect to the upper end of the manhole, to position the casting with respect thereto.

18. A method of positioning a casting in relation to an upper end of manhole, using a casting positioning apparatus as described in claim 2, the method comprising:

(a) freely inserting the lower end of the inner sleeve unit into the upper end of the manhole, while the inner sleeve unit is in the retracted position;

(b) moving the inner sleeve unit from the contracted to the expanded position so that the engaging section of the inner sleeve unit is frictionally engaged against the inside of the upper end of the manhole, so that the inner sleeve unit and a mounted casting can be supported by such engagement;

(c) retaining the inner sleeve unit in the expanded position by the inner sleeve unit adjusting means;

(d) mounting the casting on the upper end of the inner sleeve unit;

(e) moving the upper end of the inner sleeve with respect to the upper end of the manhole, to position the casting with respect thereto;

(f) freely engaging said outer sleeve unit over the mounted casting and inner sleeve unit, while the outer sleeve unit is in the second position, so that said outer sleeve unit rests on the upper end of the casting with an upper end of the outer sleeve unit extending above a lowermost end of the mounted casting;

(g) pouring fluid cement between the inner and outer sleeve units, to a height above the lowermost end of the mounted casting such that the cement, when cured, will retain the casting in position relative to the upper end of the manhole.

19. A method of positioning a casting in relation to an upper end of manhole, using a casting positioning apparatus as described in claim 6, the method comprising:

(a) freely inserting the lower end of the inner sleeve unit into the upper end of the manhole, while the inner sleeve unit is in the retracted position;

(b) moving the inner sleeve unit from the contracted to the expanded position so that the engaging section of the inner sleeve unit is frictionally engaged against the inside of the upper end of the manhole, so that the inner sleeve unit and a mounted casting can be supported by such engagement;

(c) retaining the inner sleeve unit in the expanded position by the inner sleeve unit adjusting means;

(d) mounting the casting on the upper end of the inner sleeve unit;

(e) moving the upper end of the inner sleeve with respect to the upper end of the manhole, to position the casting with respect thereto;

(f) freely engaging said outer sleeve unit over the mounted casing and inner sleeve unit, while the outer sleeve unit is in the second position, so that said outer sleeve unit rests on the upper end of the manhole with an upper end of the outer sleeve unit extending above a lowermost end of the mounted casting;

(g) pouring fluid cement between the inner and outer sleeve units, to a height above the lowermost end of the mounted casting such that the cement, when cured, will retain the casting in position relative to the upper end of the manhole.

20. A method of positioning a casting in relation to an upper end of manhole, using a casting positioning apparatus as described in claim 7, the method comprising:

(a) freely inserting the lower end of the inner sleeve unit into the upper end of the manhole, while the inner sleeve unit is in the retracted position;

(b) moving the inner sleeve unit from the contracted to the expanded position so that the engaging section of the inner sleeve unit is frictionally engaged against the inside of the upper end of the manhole, so that the inner sleeve unit and a mounted casting can be supported by such engagement;

(c) retaining the inner sleeve unit in the expanded position by the inner sleeve unit adjusting means;

(d) mounting the casting on the upper end of the inner sleeve unit;

(e) moving the upper end of the inner sleeve with respect to the upper end of the manhole, to position the casting with respect thereto;

(f) freely engaging said outer sleeve unit over the mounted casing and inner sleeve unit, while the outer sleeve unit is in the second position, so that said outer sleeve unit rests on the upper end of the manhole with an upper end of the outer sleeve unit extending above a lowermost end of the mounted casting;

(g) pouring fluid cement between the inner and outer sleeve units, to a height above the lowermost end of the mounted casting such that the cement, when cured, will retain the casting in position relative to the upper end of the manhole.

21. A method as described in claim 18, wherein the upper end of the inner sleeve unit is moved in step(e) by means of repeatedly striking the casting mounted thereon.

22. A method as described in claim 20, wherein the upper end of the inner sleeve unit is moved in step(e) by means of repeatedly striking the casting mounted thereon.

23. A method as described in claim 18, additionally comprising releasing the inner and outer sleeve adjusting means, after the cement has cured, moving the inner and outer sleeve units to their contracted and first positions respectively, and removing them from the upper end of the manhole.

24. A method as described in claim 19, additionally comprising releasing the inner and outer sleeve adjusting means, after the cement has cured, moving the inner and outer sleeve units to their contracted and first positions respectively, and removing them from the upper end of the manhole.

25. A casting positioning apparatus as described in claim 5 wherein said inner sleeve unit adjusting means comprises two vertically spaced adjusting means whereby said inner sleeve may be adjusted to the shape of a truncated cone.

* * * * *